US007671259B1

(12) United States Patent
Trinca

(10) Patent No.: US 7,671,259 B1
(45) Date of Patent: Mar. 2, 2010

(54) PROCESS FOR THE MANUFACTURE OF A TOY PIANO

(76) Inventor: Leonard Trinca, 7F St., St Augustine, FL (US) 32080

( * ) Notice: Subject to any disclaimer, the term of this patent is extended or adjusted under 35 U.S.C. 154(b) by 0 days.

(21) Appl. No.: 12/419,707

(22) Filed: Apr. 7, 2009

(51) Int. Cl.
*G10C 3/02* (2006.01)

(52) U.S. Cl. ..... 84/177; 446/173

(58) Field of Classification Search ..... 84/173–177; 446/143, 318, 391
See application file for complete search history.

(56) References Cited

U.S. PATENT DOCUMENTS 2,882,778 A * 4/1959 Scott ..... 84/95.2
D322,640 S * 12/1991 Billings ..... D21/409
5,773,738 A * 6/1998 Chou ..... 84/600
6,686,521 B2 2/2004 Sandifer
6,965,070 B2 11/2005 Wenjun

* cited by examiner

*Primary Examiner*—Kimberly R Lockett
(74) *Attorney, Agent, or Firm*—L. Jack Gibney

(57) ABSTRACT

In order to be able to salvage toy pianos that have become damaged during shipping, a process has been developed to manufacture toy pianos using a set of predetermined jigs in order to cut the parts of the piano in order to achieve uniform pieces in the event of damage to the piano and the replacement of a piece on the piano becomes necessary. Rather than the entire piano needing to be discarded the damage part can simply be removed and a new piece put in its place.

2 Claims, 3 Drawing Sheets

PROCESS FOR THE MANUFACTURE OF A TOY PIANO

BACKGROUND OF THE INVENTION

A. Field of the Invention

This relates to the manufacture of baby grand and upright toy pianos. Toy pianos are generally smaller than a typical piano and usually have around forty-five keys although there are some variations. One of the difficulties in the toy piano industry is that many of the pianos are damaged during the shipping process. Currently the sides of the toy piano are glued and it is impossible to remove the damaged part without damaging the other exterior parts of the piano. Because of the current manufacturing process, the piano must be discarded.

This application is designed to create a manufacturing process by which replacement parts are created. In the event that a part of the exterior of the piano is damaged, the replacement part can be used to replace the damaged part. In addition to reducing the costs of replacement of a piano, it would also lead to greater customer service satisfaction because the customer is not forced to wait for a replacement piano.

B. Prior Art

There are prior art references to manufacturing processes but none that involve a manufacturing process for a toy piano.

BRIEF SUMMARY OF THE INVENTION

This is a process by which baby grand and upright toy pianos may be manufactured. The essential parts of a piano are the same in both the baby grand and the upright version of the toy piano.

Baby grand and upright toy pianos rest on the floor typically with a set of legs. The exact style of the support means such as the legs may be different and may vary from company to company but each piano must be supported by a set of legs.

On the front of the piano will be a set of keys, both white and black, on which the child can play. As stated earlier, a toy piano is typically a piano with fewer keys and the child sits in front of those keys to play the instrument. A front member that forms part of the enclosure that houses the sound board will be placed perpendicular to the keys and will be connected to the bottom surface of the piano.

The legs themselves will be attached to the bottom surface of the piano and will be able to support the weight of the piano. Different style supports of legs may be used but the weight of the piano must be supported.

Secured to the bottom of the piano will be two side members a back member and a front member that will form a box around the interior components of the piano. Within the interior of the box that is formed will be the sound board that produces the music when the piano is played.

With the baby grand version a plate or protective covering will be placed above the sound board to protect the sound board. Over the top of the protective plate will be the top surface of the piano. The top surface will mate with the side members, back member and front member of the piano to compete the enclosure that houses the sound board.

These sides will be constructed from pre-sized pieces to fit a variety of pianos that will be connected by a securement means. The connection means may vary because of piano style but it is anticipated that the connection means will be threaded members.

In order to insure that the parts fit within the frame of a toy piano horizontal stop pieces that extend along the length of the side of the toy piano are provided. The horizontal stop pieces will be separated by a vertical stop piece. The vertical stop piece separates the keys of the piano from the sound board. The use of the horizontal and vertical stop pieces insures that the pieces that are cut are all uniform in length.

A hole in the horizontal stop piece is provided to secure the connection means.

Typically the damage to a toy piano occurs during the shipping process and usually the damage is to the legs or a portion of the exterior that forms the housing to protect the sound board.

With this application the damaged part is removed by removing the connection means and the replacement part is inserted in its place. In order to insure that the replacement part is aesthetically pleasing the replacement part may be manufactured with the same color paint as the original piano.

A series of slots and grooves enables the replacement parts which are installed using the connection means to easily remove the damaged part and insert a replacement part.

For instance, if the side members become damaged, the side members is replaced by removing the connection means without the need to discard the entire piano.

NUMBERING REFERENCE

Figure 1:
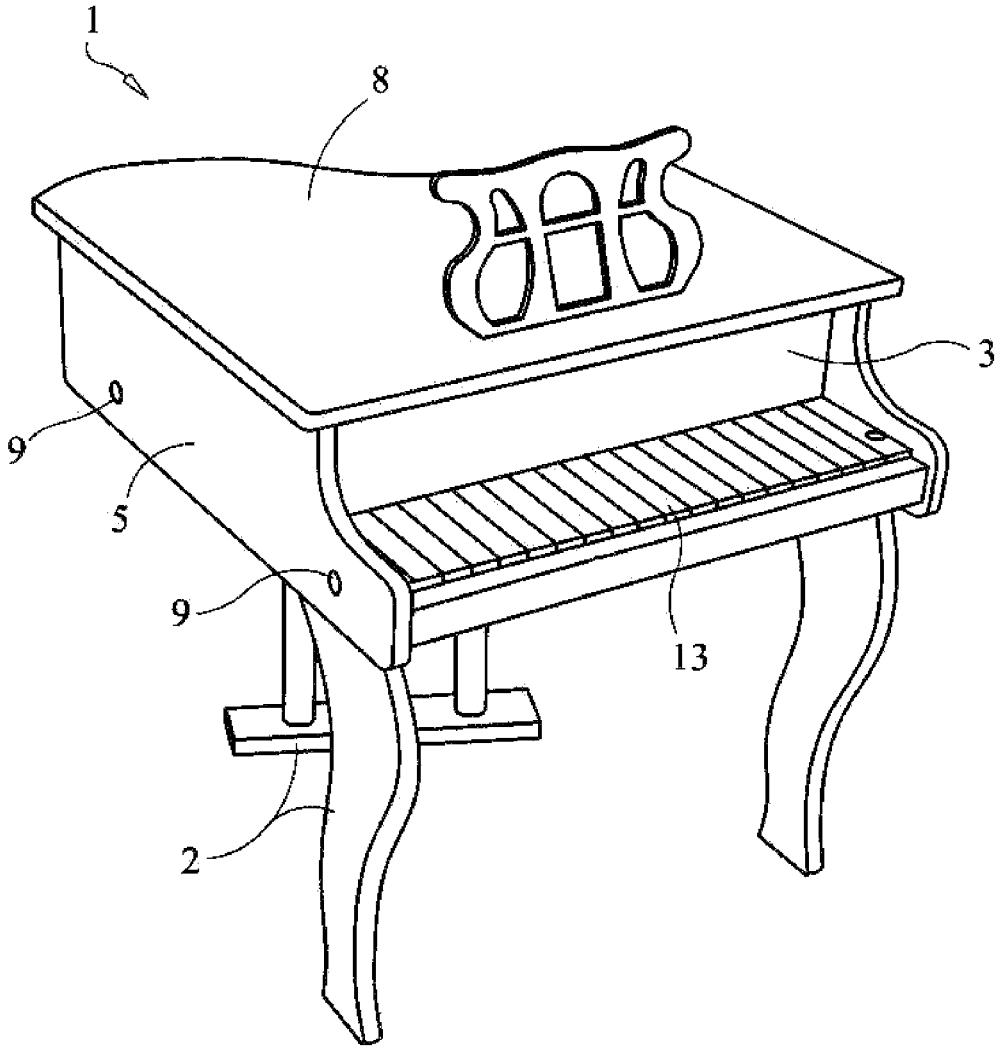
FIG. 1 is an isometric view of a baby grand toy piano.
Figure 2:
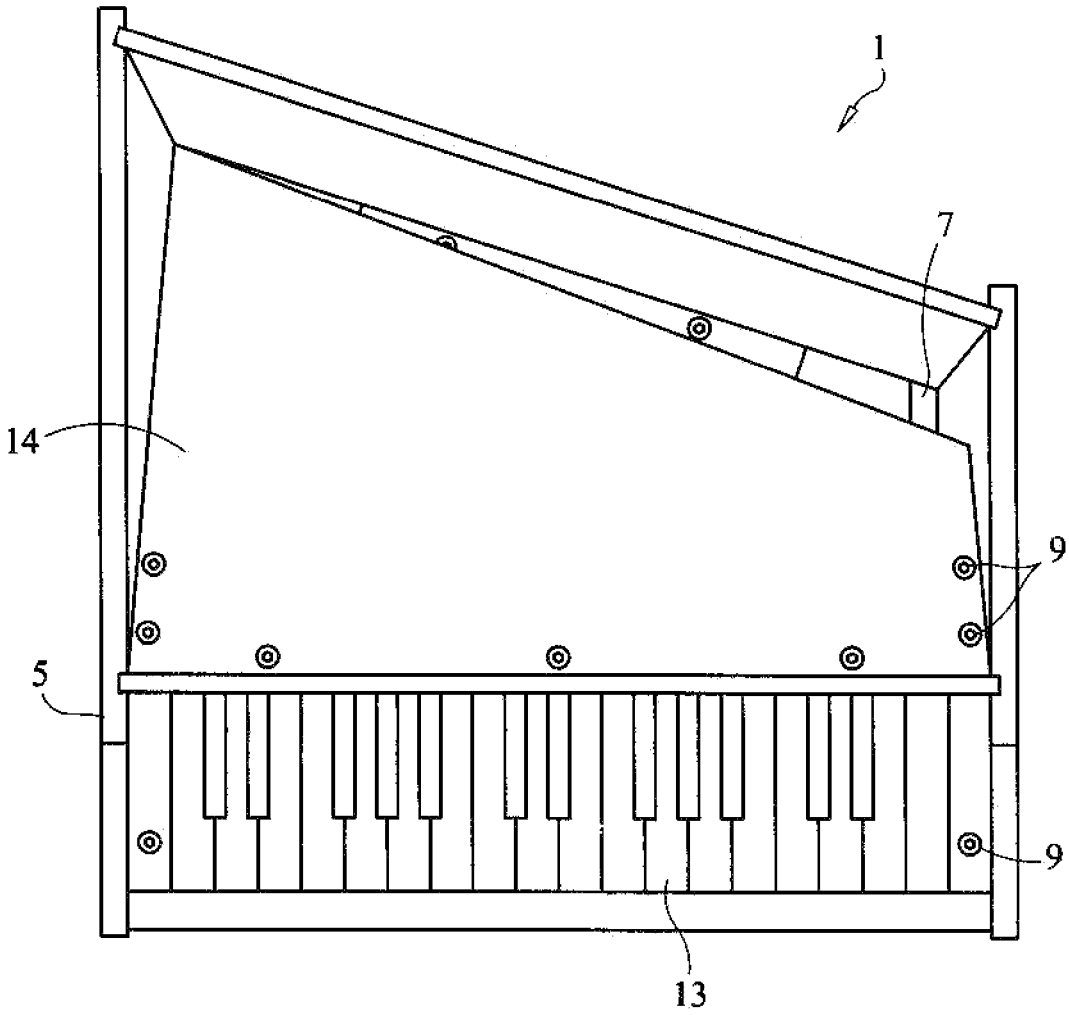
FIG. 2 is a top view of the baby grand toy piano showing the protective plate.

1—Piano
2—Legs
3—Front Member
4—Back Member
5—Side Members
6—Sound Board
7—Bottom Surface
8—Top Surface
9—Connection Means
10—Side of back member
13—Keys
14—Protective Plate
15—Hole in the Side Member
16—Stop Piece Housing
17—Hole for Connection Means
18—First Horizontal Stop Piece
19—Second Horizontal Stop Piece
20—Hole for Connection Means
21—Vertical Stop Piece
22—Second Groove
23—First Groove
24—Slits

DETAILED DESCRIPTION OF THE EMBODIMENTS

This is a process for manufacturing a toy piano 1. Toy pianos can either be manufactured as a standard upright piano or a baby grand piano. Regardless of the manufacturer, this process will be applicable to either kind of toy piano.

A toy piano is nothing more than a miniature version of a real piano. Toy pianos have a very distinctive sound when played which differentiates them from the sound of a standard piano. Like a standard piano a toy piano has a set of keys that are played by a person. Toy pianos are typically played by children and are usually given as a first piano or as a learner piano. The toy pianos also have a limited number of keys, as opposed to the 88 keys that are found on most standard upright or grand pianos.

The person plays a piano in the same manner although typically the sound on a toy piano is different than a standard upright or baby grand piano.

The piano is supported by legs 2. The legs 2 vary by the manufacturer but all pianos are supported by some type of leg. The legs 2 will be attached to the bottom surface 7 of the piano usually by a threaded member although there are a variety of ways to attach a piano leg and no specific claim is being made to the type of attachment of the piano leg. The bottom surface 7 of the piano is planar and will form one of the surfaces on which the interior components of the piano will rest and be housed.

On the planar surface will be two side members 5, a front member 3, a back member 4 and a top surface 8 that will form a cavity that will house the interior parts of the piano. When the piano is assembled the interior components of the piano will be protected by this casing.

Additionally, the keys 13 of the piano will be placed on the planar member and positioned exterior to the cavity; the front member 3 will be positioned so that the interior components of the piano cannot be damaged. The side members 5 and the back member 4 will be attached to each other.

The end 10 of the back member will be manufactured so that this portion will fit into a second groove 22 on the surface of the side member 5. A first groove 23 will allow the side member to be attached to the front member 3.

Figure 3:
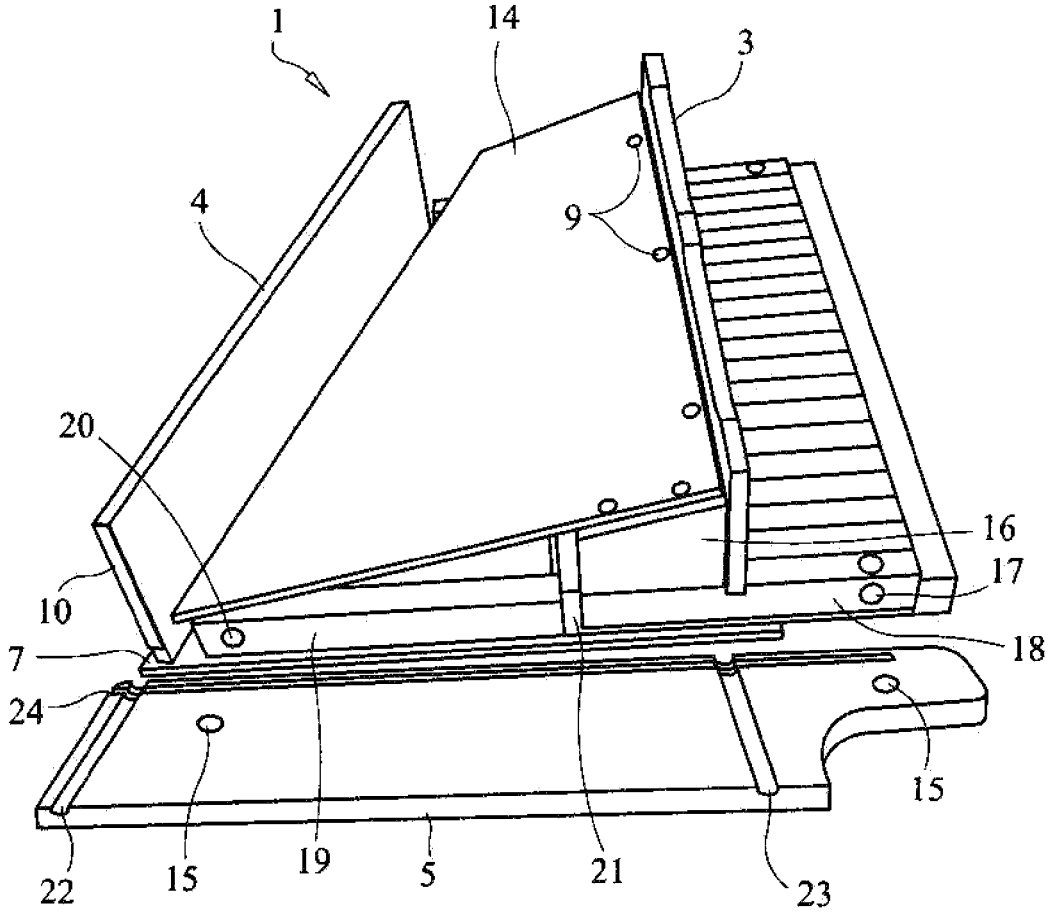
FIG. 3 is a side view of the baby grand toy piano.

On the top surface of the planar member 7 a first horizontal stop 18 will extend from the keys 13 to a vertical stop 21. A second horizontal stop 19 is placed against the vertical stop and extends the length of the piano a predetermined distance. In the case of a baby grand piano the length of the second horizontal stop on the other side of the piano as depicted in FIG. 3 will be somewhat shorter because of the shape of the baby grand piano.

Holes 15 in the side members permit a connection means 9 to be inserted into the side members as well as the first and second horizontal stops.

On the bottom of the side members slits 24 are provided that allow the side member to be inserted over the planar member of the bottom surface.

The top surface 8 of the piano will protect the interior component once it is placed on the piano. This is true regardless of whether or not the piano is a baby grand or a toy piano.

Inside the compartment formed by the side members, the back member, and the front member will be placed the sound board 6. The sound board 6 will be a board with a series of rods that will reproduce the sound of the piano when the rods are struck by components of the piano. The sound board is struck by a series of hammers that are connected to the keys 13 of the piano. Levers (not depicted) are attached to the keys 13 of the piano and are attached to hammers (not depicted) that strike the rods of the sound board.

It is imperative that the sound board be protected as much as possible and, on the top surface of the baby grand piano, there will be a protective plate 14. This protective plate will be placed between the sound board, the bottom surface 7, and the top surface 8 of the piano.

The connection means for the side members is likely a threaded member, which can be installed using a standard screwdriver, a slotted Phillips head or possibly an allen wrench.

Another stop piece housing 16 will be placed on top of a portion of the first horizontal member 18 and be placed between one surface of the vertical stop 21 and one surface of the front member 3. The protective plate 14 is secured to the stop piece 16 with a means of connection.

In the event of a side member such as reference number 5 on FIG. 3 being damaged, the connection means 9 is loosened and the side member is allowed to be removed. An identical side member can then be reinstalled simply by positioning the slots on the bottom edge of the side member and reinstalling the connection means. The first and second groove 23, 22 insure appropriate alignment of the side member 5.

The inventor claims:

1. A process for the manufacturing of a piano, which is comprised of:

a. a piano;
wherein the piano has a predetermined shape;
wherein a plurality of legs support the piano;
wherein the plurality of legs are secured to the bottom surface of a planar member;
b. side members;
wherein a plurality of side members are provided;
wherein holes on the side members are provided at predetermined locations;
wherein slits are provided near the bottom of the side members;
said slits fit over the edge of the bottom surface;
c. first groove;
wherein the first groove is of a predetermined shape;
said first groove is placed over the end of the front member;
d. second groove;
wherein the second groove is of a predetermined shape;
wherein the second groove is placed over the end surface of a back member;
e. means of connection;
wherein the means of connection passes through the holes of the side member;
f. a back member;
wherein a back member is provided;
g. a front member;
wherein a front member is provided;
h. sound board;
wherein a sound board is provided;
said sound board reproduces the sound of a toy piano;
said sound board is secured to the top surface of the bottom surface;
i. protective plate;
wherein a protective plate is placed over the sound board;
wherein a means of connection secures the protective plate;
j. first horizontal member;
wherein a first horizontal member is placed on the top of the bottom surface;
wherein a hole for the means of connection is provided on the first horizontal member;
k. second horizontal member;
wherein a second horizontal member is placed on the top of the bottom surface;
wherein a hole for the means of connection is provided on the second horizontal member;
l. vertical stop;
wherein a vertical stop is provided;
wherein the vertical stop is placed between the first horizontal member and the second horizontal member;
m. stop piece housing;
wherein a stop piece housing is placed between the vertical stop and the front member;
wherein the protective plate is secured to the stop piece housing;
wherein the stop piece housing extends from one edge of the piano to the other.

2. The process as described in claim 1 wherein the means of connection is a threaded member.

* * * * *